US007764913B2

(12) United States Patent
Tsunoda

(10) Patent No.: US 7,764,913 B2
(45) Date of Patent: Jul. 27, 2010

(54) FIXING DEVICE AND IMAGE FORMING APPARATUS

(75) Inventor: Shigeru Tsunoda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 297 days.

(21) Appl. No.: 11/723,007

(22) Filed: Mar. 15, 2007

(65) Prior Publication Data

US 2008/0131179 A1 Jun. 5, 2008

(30) Foreign Application Priority Data

Mar. 31, 2006 (JP) ..... 2006-096433

(51) Int. Cl.
*G03G 15/20* (2006.01)

(52) U.S. Cl. ..... 399/329

(58) Field of Classification Search ..... 399/67, 399/68, 122, 320, 328, 329, 330, 331; 219/216
See application file for complete search history.

(56) References Cited

U.S. PATENT DOCUMENTS 6,249,657 B1 * 6/2001 Kagawa ..... 399/67
6,282,398 B1 * 8/2001 Higashi ..... 399/329
6,763,218 B2 * 7/2004 Hamada et al. ..... 399/329
7,113,716 B2 * 9/2006 Tomatsu ..... 399/67
7,327,979 B2 * 2/2008 Katayanagi ..... 399/329

FOREIGN PATENT DOCUMENTS

JP 09-034291 2/1997

* cited by examiner

*Primary Examiner*—Hoan Tran
(74) *Attorney, Agent, or Firm*—Kubotera & Associates LLC

(57) ABSTRACT

A fixing device includes a heating member for heating a recording medium having a developer image; a pressing member for pressing the recording medium against the heating member; a supporting member for supporting the pressing member; a supporting shaft for supporting the supporting member to be freely rotatable; and an urging member for urging the supporting member in a specific rotational direction and urging the pressing member against the heating member.

10 Claims, 12 Drawing Sheets

FIXING DEVICE AND IMAGE FORMING APPARATUS

BACKGROUND OF THE INVENTION AND RELATED ART STATEMENT

The present invention relates to a fixing device and an image forming apparatus.

In a conventional image forming apparatus such as a printer, a copier, and a facsimile, an image is formed through the following process. First, a charge roller charges a surface of a photosensitive drum. An exposure device such as an LED head exposes the surface of the photosensitive drum to form a static latent image or a latent image thereon. A developing roller attaches a thin layer of toner to the static latent image to form a toner image. A transfer roller transfers the toner image to a sheet. A fixing unit or fixing device fixes the toner image to the sheet before discharging the sheet.

Patent Reference has disclosed a conventional fixing device of a belt nip type. The conventional fixing device is provided with a pressing pad pressed against a fixing roller or a fixing member through a pressing belt.

FIG. 2 is a schematic sectional view showing the conventional fixing device. As shown in FIG. 2, a fixing device 101 includes a pressing belt assembly 102; a fixing roller 103 facing the pressing belt assembly 102; a pressing belt 105; a pressing pad 106; a spring 107 for urging the pressing pad 106 against the fixing roller 103 through the pressing belt 105; a holder 108 for holding the pressing pad 106; and a heater 111.

In the fixing device 101, the holder 108 is guided with a guide member (not shown) to freely slide back and forth. A nip portion n is formed between the pressing belt assembly 102 and the fixing roller 103. After a toner image is transferred to a sheet, when the sheet passes through the nip portion n, the fixing roller 103 heats the toner image and the pressing belt assembly 102 applies pressure to the toner image, so that the toner image is fixed to the sheet.

Patent Reference Japanese Patent Publication No. 09-34291

In the conventional fixing device 101, when the pressing belt 105 moves, an inner circumferential surface of the pressing belt 105 slides against an upper surface of the pressing pad 106, thereby causing frictional resistance. Accordingly, the pressing pad 106 may be inclined, vibrate, or wobble, so that the holder 108 may seize the guide member. As a result, it is difficult to stably press the pressing pad 106 against the fixing roller 103, thereby causing distortion, shift, or irregularity in an image, and lowering image quality.

In view of the problems described above, an object of the present invention is to provide a fixing device and an image forming apparatus capable of solving the problems of the conventional fixing device. In the fixing device, it is possible to stably press a pressing pad against a fixing member, thereby improving image quality.

Further objects and advantages of the invention will be apparent from the following description of the invention.

SUMMARY OF THE INVENTION

In order to attain the objects described above, according to the present invention, a fixing device comprises a heating member for heating a recording medium having a developer image; a pressing member for pressing the recording medium against the heating member; a supporting member for supporting the pressing member; a supporting shaft for supporting the supporting member to be freely rotatable; and an urging member for urging the supporting member in a specific rotational direction and urging the pressing member against the heating member.

In the invention, the fixing device comprises the heating member for heating the recording medium having the developer image; the pressing member for pressing the recording medium against the heating member; the supporting member for supporting the pressing member; the supporting shaft for supporting the supporting member to be freely rotatable; and the urging member for urging the supporting member in the specific rotational direction and urging the pressing member against the heating member.

In particular, the supporting shaft supports the supporting member to be freely rotatable, and the supporting member supports the pressing member. Further, the urging member urges the supporting member in the specific rotational direction, and urges the pressing member against the heating member. Accordingly, the pressing member is not inclined, or does not vibrate or wobble, so that the pressing member does not seize other component. As a result, it is possible to stably press the pressing member against the heating member, thereby preventing distortion, shift, or irregularity in an image, and improving image quality.

DETAILED DESCRIPTION OF PREFERRED EMBODIMENTS

Hereunder, embodiments of the present invention will be explained with reference to the accompanying drawings. In the embodiments, a printer is used as an image forming apparatus for forming an image.

First Embodiment

Figure 3:
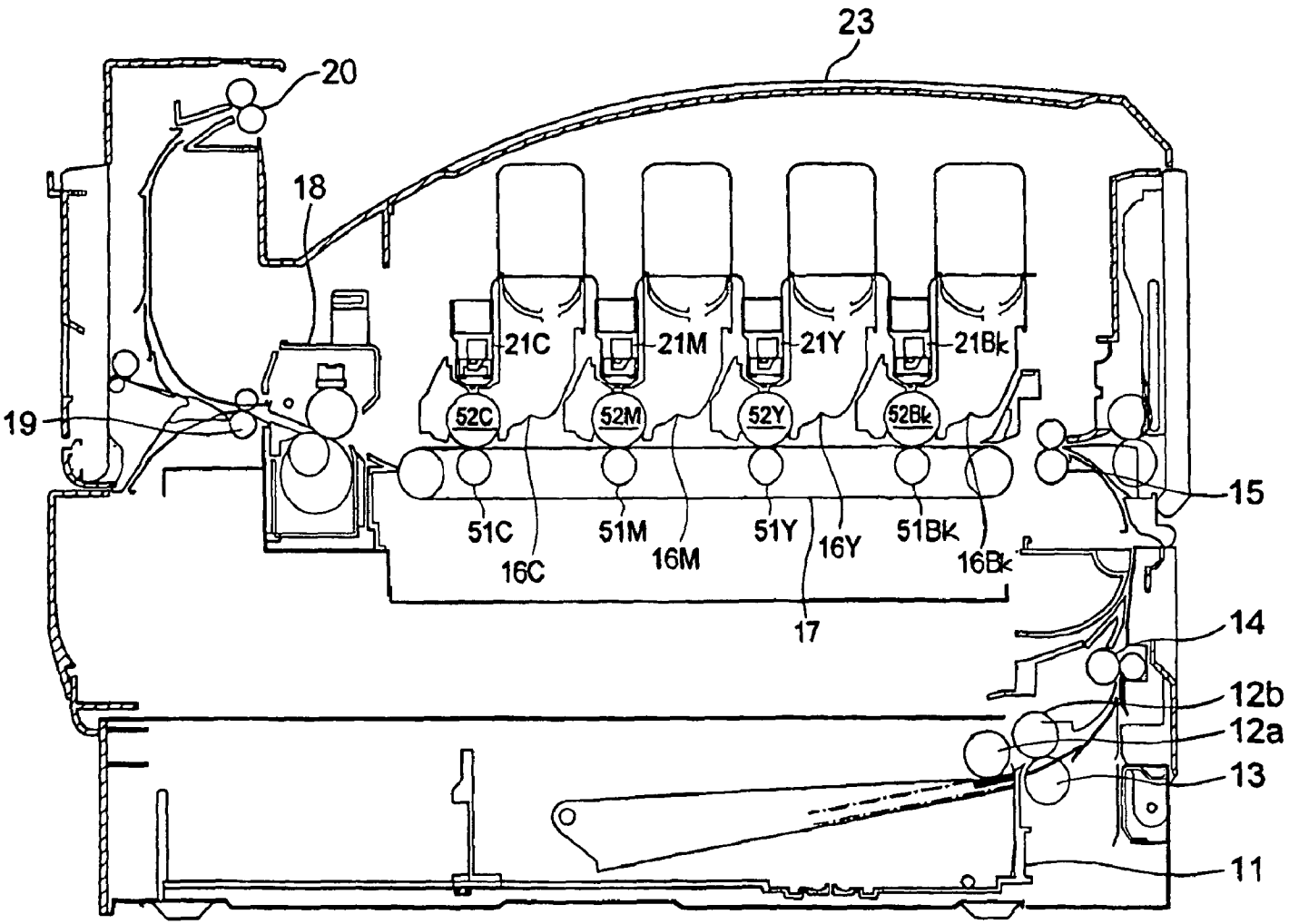
FIG. 3 is a schematic sectional view showing a printer according to the first embodiment of the present invention.

A first embodiment of the present invention will be explained. FIG. 3 is a schematic sectional view showing a printer according to the first embodiment of the present invention.

As shown in FIG. 3, the printer includes a sheet supply cassette 11 as a recording medium storage unit disposed at a lower portion of the printer for storing a sheet (not shown) as a recording medium. A sheet supply mechanism is disposed adjacent to a front end of the sheet supply cassette 11 for separating and transporting the sheet one by one. The sheet supply mechanism includes sheet supply rollers 12*a* and 12*b* and a separation roller 13.

In the embodiment, the sheet supply mechanism transports the sheet to a transport roller 14 disposed above the sheet supply mechanism, and then transports the sheet further to a transport roller 15. Afterward, a transport belt 17 as a transport member or a first transfer member moves and transports the sheet, so that the sheet passes through between image forming units 16Bk, 16Y, 16M, and 16C as image forming devices for forming images in black, yellow, magenta, and cyan, and transfer rollers 51Bk, 51Y, 51M, and 51C as second transfer members.

In the image forming units 16Bk, 16Y, 16M, and 16C, photosensitive drums 52Bk, 52Y, 52M, and 52C as image supporting members form toner images or developer images in each color. The transfer rollers 51Bk, 51Y, 51M, and 51C transfer the toner images to the sheet, thereby forming a toner image in colors. A transfer unit is formed of the transport belt 17 and the transfer rollers 51Bk, 51Y, 51M, and 51C.

In the embodiment, after transferring the toner image, the sheet is transported to a fixing device 18 of a belt nip type as a fixing unit. The fixing device 18 fixes the toner image in colors to the sheet, thereby forming an image in colors. After the sheet is discharged from the fixing device 18 and transported with a transport roller 19, a discharge transport roller 20 discharges the sheet outside the printer.

In the embodiment, LED heads 21Bk, 21Y, 21M, and 21C as exposure devices are arranged to face the image forming units 16Bk, 16Y, 16M, and 16C for exposing surfaces of the photosensitive drums 52Bk, 52Y, 52M, and 52C to form latent images. The image forming units 16Bk, 16Y, 16M, and 16C are detachably attached to a main body of the printer. An upper cover 23 is disposed at an upper portion of the printer to freely open and close. The LED heads 21Bk, 21Y, 21M, and 21C are supported on the upper cover 23.

In the embodiment, the sheet includes an ordinary copy paper, and may include a special sheet such as an OHP sheet, a card, a postcard, a cardboard with an area weight of more than 100 g/m$^2$, an envelope, and a coated sheet with large heat capacity.

An operation of the printer will be explained next. First, the sheet supply rollers 12*a* and 12*b* and the separation roller 13 separate and transport the sheet stored in the sheet supply cassette 11 one by one. Then, the transport rollers 14 and 15 transport the sheet to the transport belt 17. The photosensitive drums 52Bk, 52Y, 52M, and 52C are charged with a charge roller, and the LED heads 21Bk, 21Y, 21M, and 21C expose the surfaces of the photosensitive drums 52Bk, 52Y, 52M, and 52C to form the latent images. A developing roller develops the latent images to form the toner images or the developer images on the photosensitive drums 52Bk, 52Y, 52M, and 52C.

When the transport belt 17 moves to transport the sheet, the sheet passes through between the photosensitive drums 52Bk, 52Y, 52M, and 52C and the transfer rollers 51Bk, 51Y, 51M, and 51C for sequentially transferring the toner images in black, yellow, magenta, and cyan to the sheet, thereby forming the toner image in colors.

After transferring the toner images, the sheet is transported to the fixing device 18 for fixing the toner image in colors to the sheet, thereby forming the image in colors. A cleaning blade as a cleaning device scrapes and removes toner remaining on the photosensitive drums 52Bk, 52Y, 52M, and 52C after transferring the toner images, so that toner can be used in a next charging operation.

Figure 1:
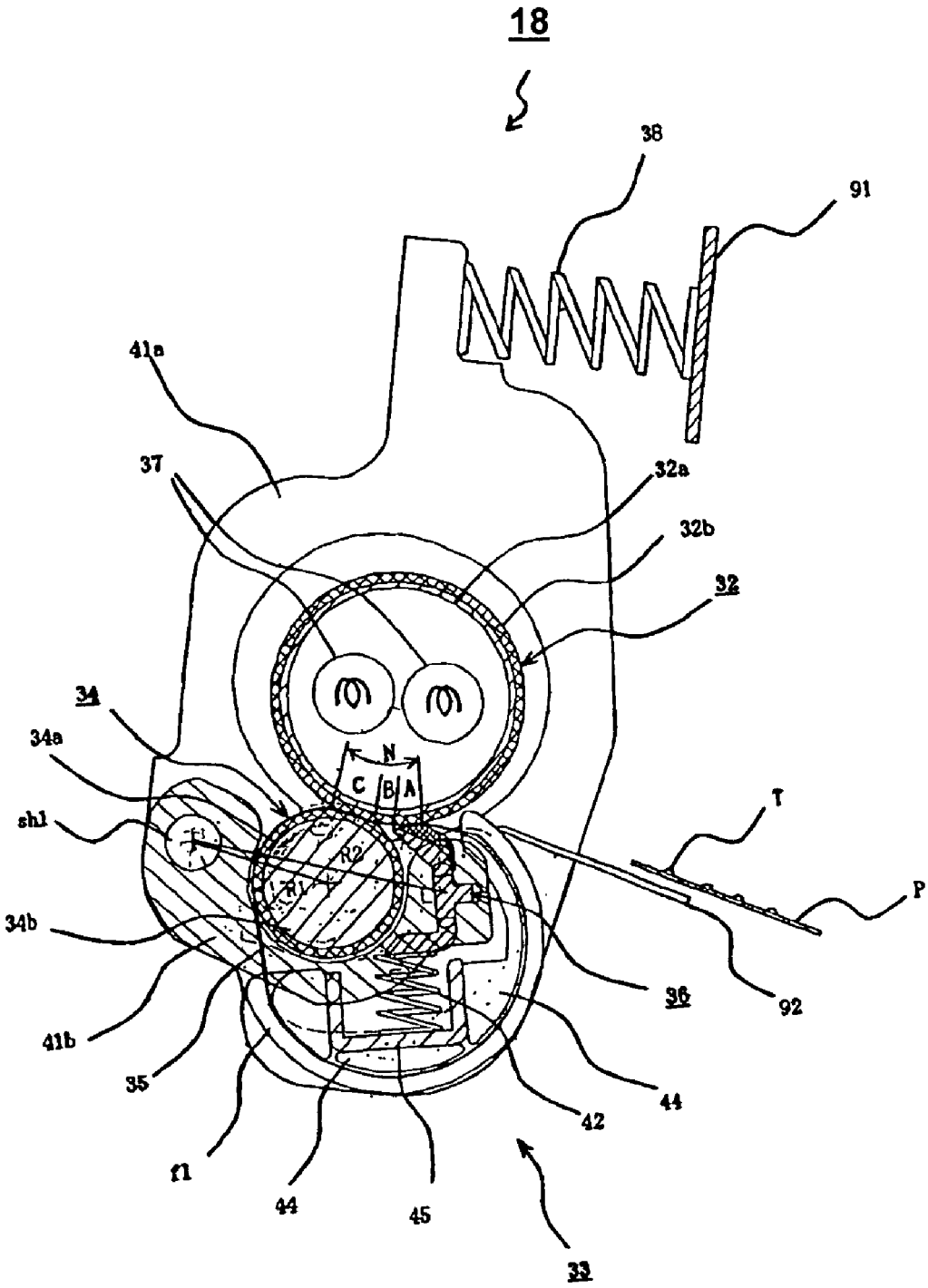
FIG. 1 is a schematic sectional view showing a fixing device according to a first embodiment of the present invention.
Figure 4:
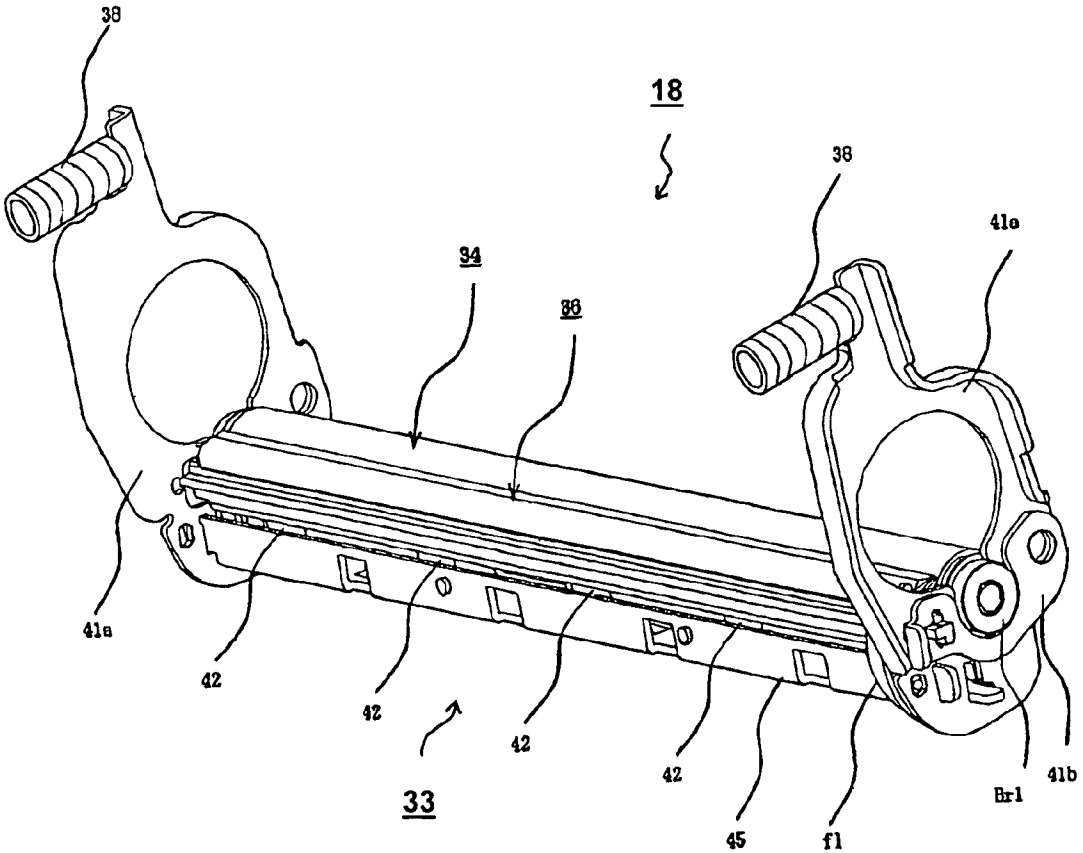
FIG. 4 is a perspective view showing a primary portion of the fixing device according to the first embodiment of the present invention.
Figure 5:
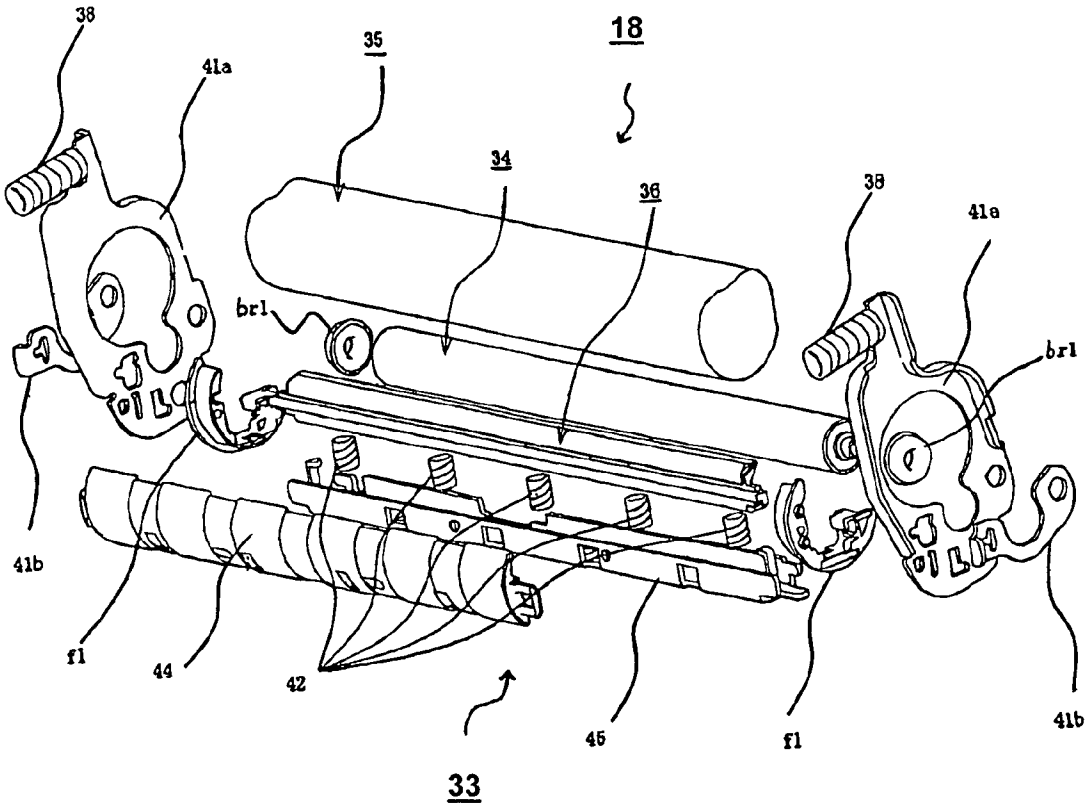
FIG. 5 is an exploded perspective view showing the primary portion of the fixing device according to the first embodiment of the present invention.

The fixing device 18 will be explained next. FIG. 1 is a schematic sectional view showing the fixing device 18 according to the first embodiment of the present invention. FIG. 4 is a perspective view showing a primary portion of the fixing device 18 according to the first embodiment of the present invention. FIG. 5 is an exploded perspective view showing the primary portion of the fixing device 18 according to the first embodiment of the present invention.

Figure 6:
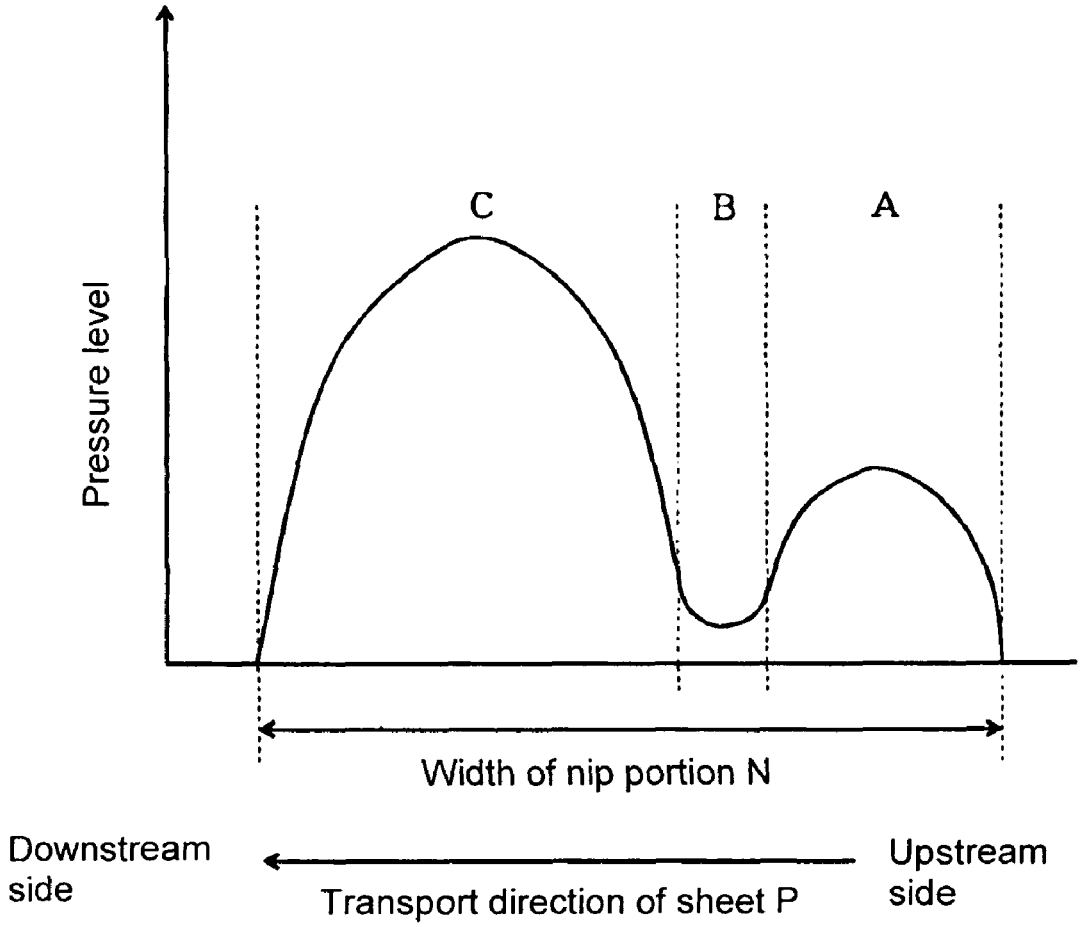
FIG. 6 is a graph showing a pressure distribution of a nip portion of the fixing device according to the first embodiment of the present invention.
Figure 7:
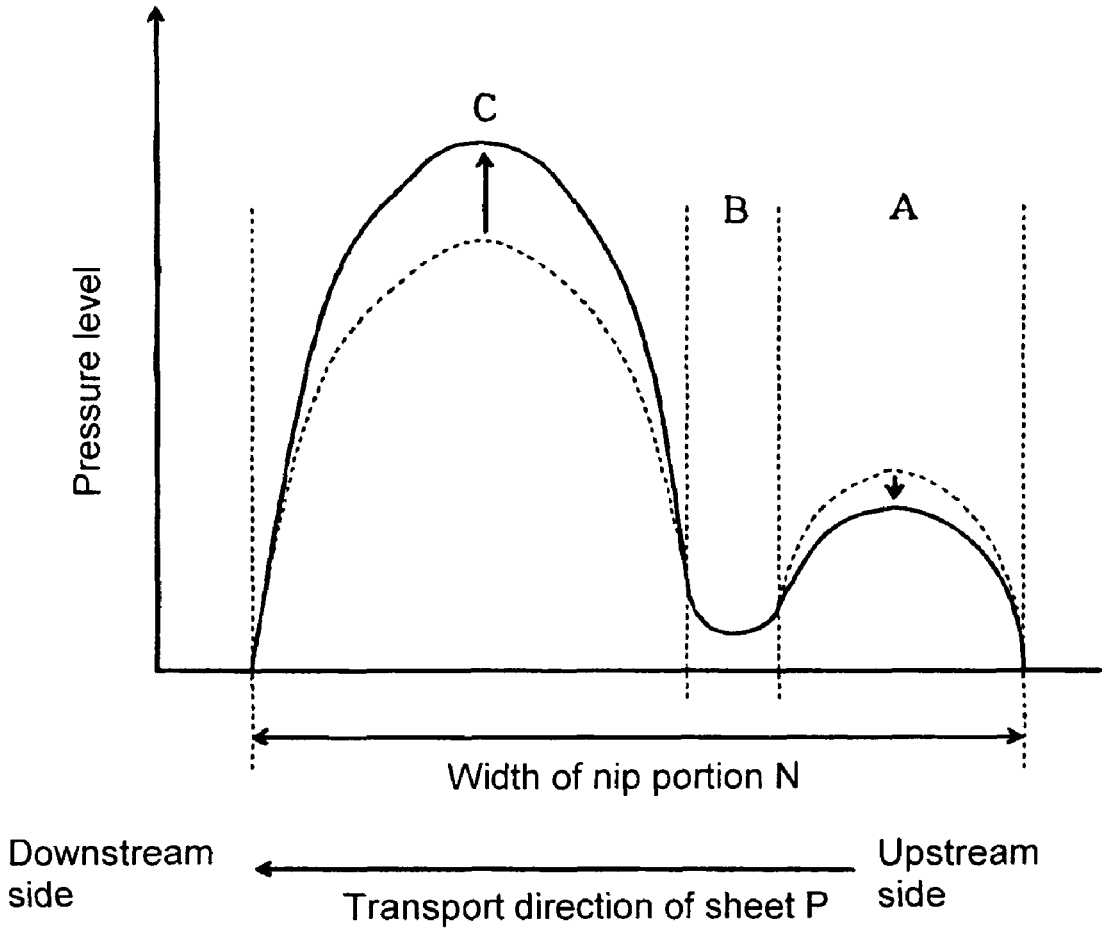
FIG. 7 is a graph No. 1 showing a pressure distribution of a nip portion of a conventional fixing device.
Figure 8:
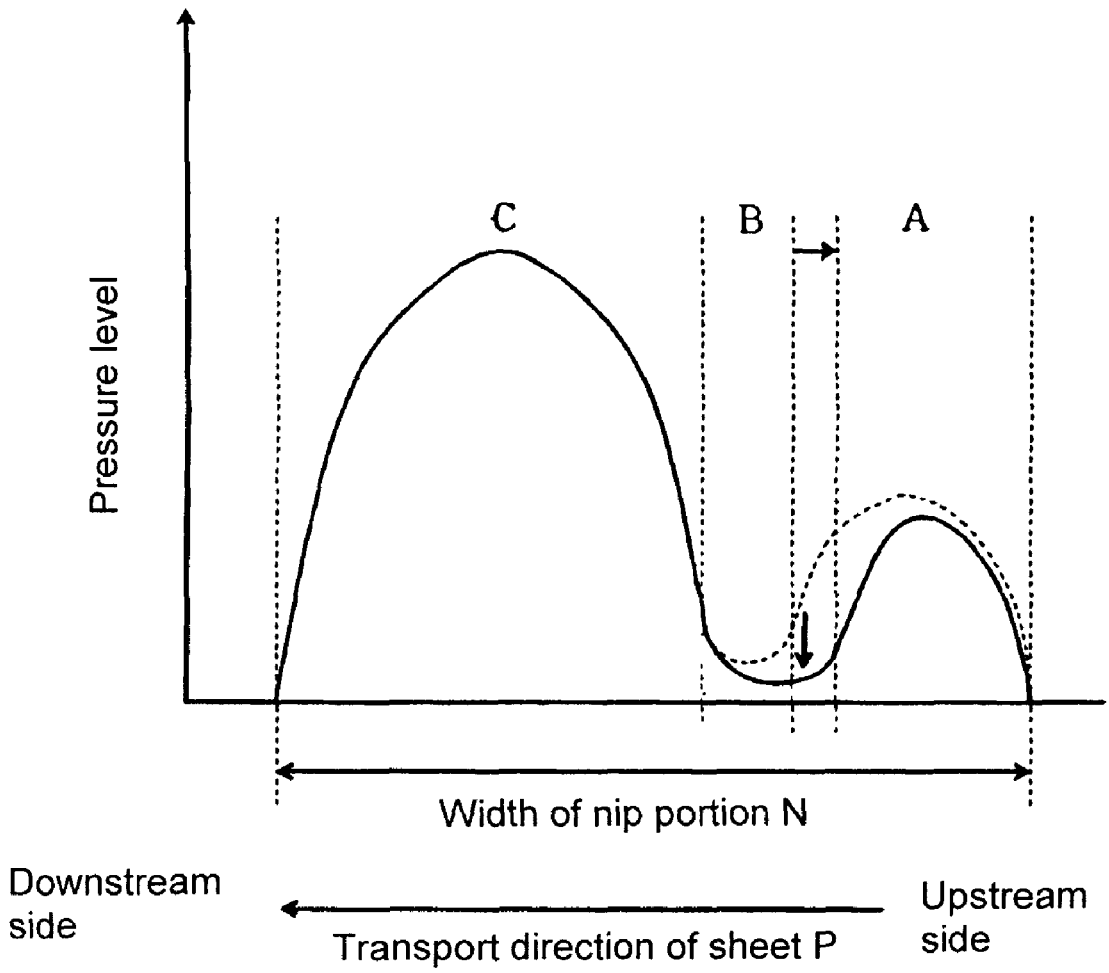
FIG. 8 is a graph No. 2 showing a pressure distribution of the nip portion of the conventional fixing device.
Figure 9:
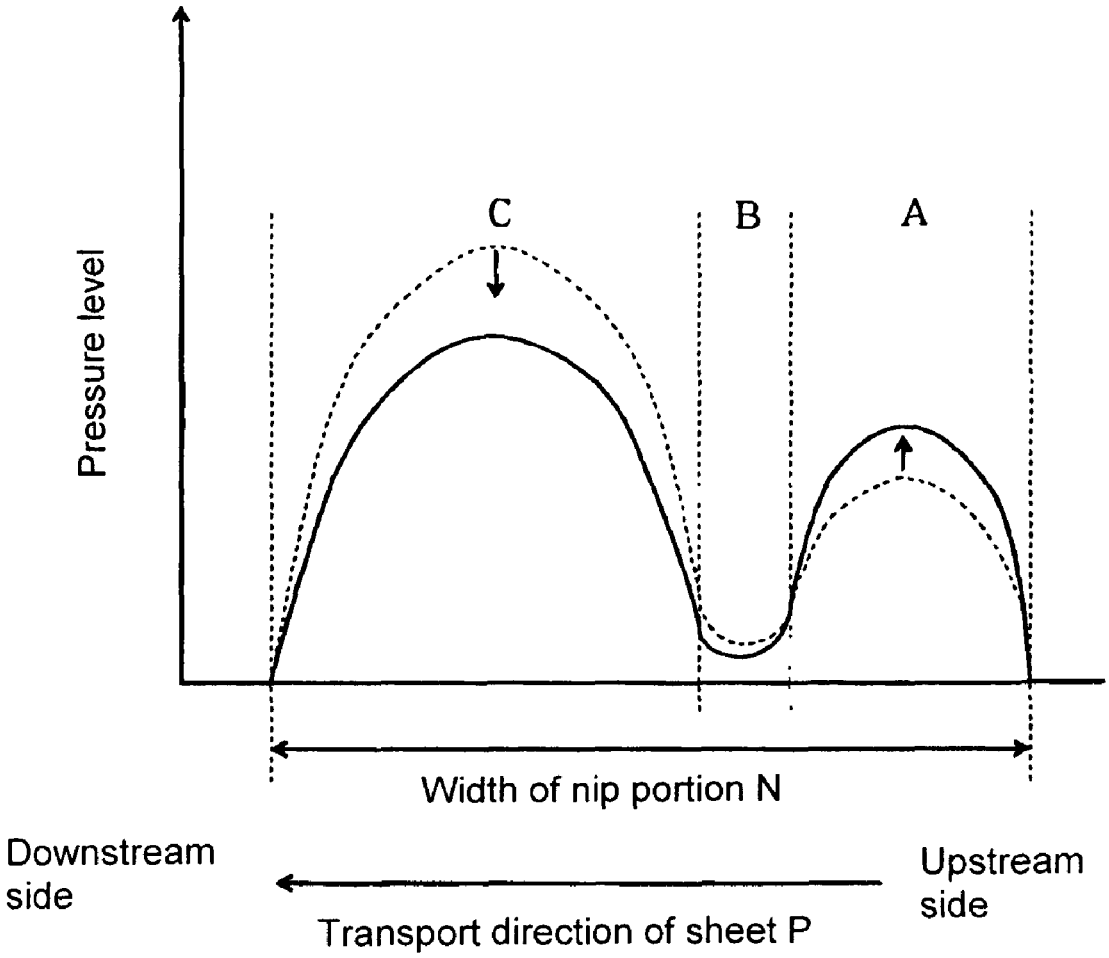
FIG. 9 is a graph No. 3 showing a pressure distribution of the nip portion of the conventional fixing device.

Further, FIG. 6 is a graph showing a pressure distribution of a nip portion of the fixing device 18 according to the first embodiment of the present invention. FIG. 7 is a graph No. 1 showing a pressure distribution of a nip portion of a conventional fixing device. FIG. 8 is a graph No. 2 showing a pressure distribution of the nip portion of the conventional fixing device. FIG. 9 is a graph No. 3 showing a pressure distribution of the nip portion of the conventional fixing device. In each of FIGS. 6 to 9, a horizontal axis represents a width of the nip portion and a vertical axis represents a pressure level.

As shown in FIG. 1, a fixing roller 32 as a fixing member is pressed against a pressing belt assembly 33 as a pressing unit. A nip portion N is formed between the fixing roller 32 and the pressing belt assembly 33 for fixing a toner image T that is not fixed to a sheet P yet.

In the embodiment, the fixing roller 32 is supported on a bearing (not shown) to be freely rotatable, and is driven with a fixing motor (not shown) as a drive device to rotate clockwise at a specific circumferential speed. A thermistor (not shown) is disposed as a temperature detection unit adjacent to a surface of the fixing roller 32. A heater 37 is disposed in the fixing roller 32 as a heating member or a heating source. The heater 37 is formed of a halogen lamp, and may include an induction heating member instead of the halogen lamp.

In the embodiment, the pressing belt assembly 33 includes a pressing roller 34 as a pushing member, a pressing belt 35 with an endless shape as a belt member, and a pressing pad 36 as a pressing member. A pair of springs 38 is provided as a first urging member for urging the pressing roller 34 toward the fixing roller 32, so that the pressing roller 34 is pressed against the fixing roller 32 through the pressing belt 35 with a specific pressure or a pressing force. Accordingly, the sheet P is pressed against the fixing roller 32. Further, the pressing belt 35 is placed in a contact state with the fixing roller 32. The springs 38 are formed of a coil spring.

In the embodiment, the pressing pad 36 is disposed inside the pressing belt 35 at an upstream side of the pressing roller 34 in a direction that the pressing belt 35 moves. A plurality of springs 42 is provided as a second urging member for urging the pressing pad 36 toward the fixing roller 32, so that the pressing pad 36 is pressed against the fixing roller 32 through the pressing belt 35 with a specific pressing force. Accordingly, the sheet P is pressed against the fixing roller 32. The springs 42 are formed of a coil spring.

In the embodiment, the nip portion N is a contact area of the pressing belt 35 and the fixing roller 32 between the pressing roller 34 and the pressing pad 36. When the fixing roller 32 rotates, the pressing belt 35 moves with friction generated between the pressing belt 35 and the fixing roller 32 at the nip portion N. It is possible to easily change a width of the nip portion N (width in a direction that the pressing belt 35 moves) through changing a width of the pressing pad 36.

In the embodiment, the fixing roller 32 is formed of a hollow roller having an outer diameter of about 28 mm. In the fixing roller 32, a core metal portion is covered with an elastic layer 32*a* made of a porous silicone rubber with high temperature resistance and having a thickness of about 1.2 mm. Further, an outer circumferential surface is coated with a fluorine resin layer 32*b* as a release layer having a thickness of 30 μm. The core metal portion is formed of metal such as iron and steel, and may be formed of other metal such as aluminum.

In the embodiment, the pressing belt 35 has a two-layer structure formed of a base layer and a release layer coated on the base layer. The base layer is formed of a polyimide with high temperature resistance, and is formed in a belt member having a diameter of 30 mm and a thickness of 80 μm. The release layer is formed of a PFA coating having a thickness of 20 μm.

In the embodiment, the pressing roller 34 is formed of a material having hardness higher than at least that of the fixing roller 32. Accordingly, the fixing roller 32 elastically deforms at a pressing portion of the pressing roller 34 relative to the fixing roller 32, thereby maintaining a self-stripping function of the sheet P.

In the embodiment, the pressing roller 34 is formed of an elastic member having an outer diameter of 34 mm. More specifically, a metal core shaft 34*a* is covered with an elastic member 34*b* formed of a silicone sponge with heat resistance and having a thickness of 1 mm. The silicone sponge has a crown shape having an outer diameter difference of 0.1 mm to obtain a uniform pressure distribution along an axial direction of the pressing roller 34. Further, the pressing roller 34 and the fixing roller 32 form a nip portion C having a nip width of about 4 mm.

In the embodiment, the pressing pad 36 is formed of a base member; a heat resistant resin layer partially formed on the base member at a specific location; and a low friction member formed on a surface contacting with the pressing belt 35. Further, the pressing pad 36 is disposed such that the low friction member contacts with an inner surface of the pressing pad 36.

The base member is formed of a metal member formed through an extruding process or a drawing process, i.e., an aluminum extruded member in the embodiment. The heat resistant resin layer is formed of a silicone rubber having a hardness of 15 to 40° (JIS A). In the embodiment, the heat resistant resin layer has a hardness of 40° and a thickness of about 1.0 mm. The heat resistant resin layer contacts with the pressing belt 35 in a contact width of about 4.0 mm.

In the embodiment, the pressing pad 36 has a crown shape having a center portion protruding by 0.1 mm relative to both end portions thereof to obtain a uniform pressure distribution along a longitudinal direction of the pressing pad 36. The low friction member is provided for reducing friction between the inner surface of the pressing belt 35 and a surface of the pressing pad 36. The low friction member is formed of a silicone type coating containing graphite, and has a thickness of 20 μm.

In the embodiment, the pressing pad 36 is disposed apart from the pressing roller 34 by about 1.0 mm. A plurality of springs 42 is disposed along the axial direction of the fixing roller 32 for urging the pressing pad 36 against the fixing roller 32 through the pressing belt 35. Further, the pressing pad 36 and the fixing roller 32 form a nip portion A having a nip width of about 4.0 mm with the pressing belt 35 inbetween.

FIG. 6 is a graph showing a pressure distribution of the nip portion of the fixing device 18 according to the first embodiment of the present invention. As shown in FIG. 6, the pressing pad 36 is pressed against the fixing roller 32 in the nip portion A with an average surface pressure smaller than an average surface pressure of the pressing roller 34 pressed against the fixing roller 32 in the nip portion C. The average surface pressure is calculated from a total pressure applied in the nip portion A or C divided by an area of the nip portion A or C.

In the embodiment, the springs 38 urge the pressing roller 34 and the springs 42 urge the pressing pad 36 such that the average surface pressure in the nip portion C becomes about 2.0 kg/cm$^2$ and the average surface pressure in the nip portion A becomes about 0.8 kg/cm$^2$. Further, the pressing belt 35 and the fixing roller 32 form a nip portion B (small pressure portion), and the pressing belt 35 is pressed against the fixing roller 32 in the nip portion B with tension thereof.

In the embodiment, both end portions of the pressing roller 34 are supported on pressing roller levers 41*a* disposed at left and right sides as a first supporting member through bearings br1, so that the pressing roller 34 is freely rotatable. The pressing roller levers 41*a* are disposed to be freely rotatable around supporting shafts sh1 (FIG. 1) disposed on both side surfaces. The springs 38 are disposed between the pressing roller levers 41*a* and a front plate 91 (FIG. 1). Accordingly, the springs 38 urge the pressing roller levers 41*a* in a counterclockwise direction (FIG. 1), so that the pressing roller 34 is urged toward the fixing roller 32.

In the embodiment, both end portions of the pressing pad 36 are fixed and supported to pressing pad levers 41*b* disposed at left and right sides as a second supporting member. The pressing pad levers 41*b* are disposed to be freely rotatable around the supporting shafts sh1 (FIG. 1) disposed on both side surfaces. The springs 42 are disposed between the pressing pad levers 41*b* and a frame member 45 fixed to the pressing pad levers 41*b* (FIG. 1), so that the springs 42 urge the pressing pad 36 toward the fixing roller 32. The springs 42 are disposed along the longitudinal direction of the pressing pad 36 to make the pressure distribution uniform at the nip portion A in the longitudinal direction.

A guide member 44 is disposed around the frame member 45 for guiding the pressing belt 35. Accordingly, the pressing belt 35 does not receive tension along a circumferential direction thereof except the nit portion N and surrounding areas thereof.

When the pressing belt 35 moves, the pressing belt 35 tries to move in the axial direction of the pressing roller 34, that is, the longitudinal direction of the pressing pad 36. However, an end portion of the pressing belt 35 contacts with an inner side surface of one of flange members f1 formed between the guide member 44 and the pressing pad levers 41*b*, thereby restricting the lateral movement of the pressing belt 35.

In the embodiment, the supporting shafts sh1 are disposed such that a rotational radius R1 of the pressing roller 34 with the pressing roller levers 41*a* becomes smaller than or equal to a rotational radius R2 of the pressing pad 36 with the pressing pad levers 41*b* (R1≦R2). Further, the pressing roller levers 41*a* and the pressing pad levers 41*b* are disposed to be rotatable around the common supporting shafts sh1, thereby reducing the number of parts and a size of the fixing device 18. Alternatively, the pressing roller levers 41*a* and the pressing pad levers 41*b* may be disposed to be rotatable around different supporting shafts.

An operation of the fixing device 18 will be explained next. When the printer starts a printing operation, in the fixing device 18, the fixing roller 32 starts rotating. That is, a gear disposed on one end of the fixing roller 32 engages a drive gear fixed to an output shaft of the fixing motor inside the main body of the printer, so that the fixing roller 32 rotates in a direction for transporting the sheet P. When the fixing roller 32 rotates, the pressing belt 35 moves through friction with the fixing roller 32 at the nip portion N.

A current is supplied to the heater 37 from a power supply circuit (not shown), so that the heater 37 heats the fixing roller 32 from inside thereof. The thermistor (not shown) detects a surface temperature of the fixing roller 32 thus heated, and inputs a result to a temperature control circuit of a control unit (not shown). The temperature control circuit controls the power supply circuit to supply the current to the heater 37 according to the surface temperature of the fixing roller 32, thereby maintaining the surface temperature of the fixing roller 32 at a fixing temperature.

In the state that the heater 37 heats the fixing roller 32 such that the surface temperature thereof is maintained at the fixing temperature, the sheet P is transported to the nip portion N through the guide member 92. At the nip portion N, the toner image T (FIG. 1) is heated and fixed to the sheet P as a fixed image.

Figure 2:
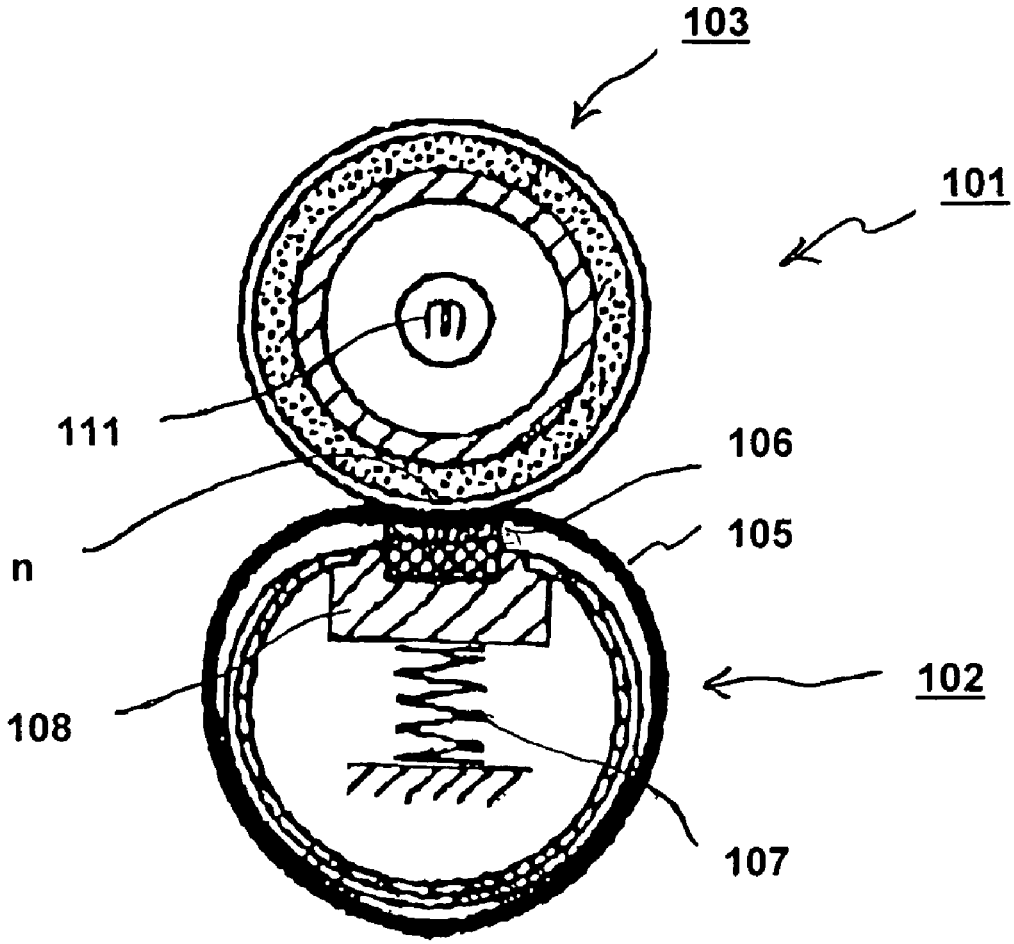
FIG. 2 CONVENTIONAL ART
FIG. 2 is a schematic sectional view showing a conventional fixing device.

In a conventional fixing device 101 shown in FIG. 2, a pressing pad 106 is disposed to be freely rotatable relative to a guide member. Accordingly, the pressing pad 106 may be inclined, vibrate, or wobble, so that the pressing pad 106 may seize the guide member.

In the conventional fixing device 101, when the pressing pad 106 seizes other component and the pressing pad 106 does not move back to an original pressing position, the pressing pad 106 is urged toward a fixing roller 103 with a smaller force. Since springs urge the pressing pad 106, a reactive force is applied to a frame member to move downward and is applied to pressing roller levers to rotate in a clockwise direction. Accordingly, as shown in FIG. 7, when a pressure level at a nip portion A decreases, a pressure level at a nip portion C increases.

On the other hand, in the embodiment, the pressing pad 36 is fixed to the pressing pad levers 41*b* to be freely rotatable around the supporting shafts sh1 disposed outside the pressing belt 35. Accordingly, the pressing pad 36 is not inclined, or does not vibrate or wobble, so that the pressing pad 36 does not seize other component. As a result, it is possible to stably press the pressing pad 36 against the fixing roller 32, thereby preventing distortion, shift, or irregularity in an image, and improving image quality.

Further, it is possible to stably press the pressing pad 36 against the fixing roller 32 with a uniform force in the longitudinal direction of the pressing pad 36, thereby preventing distortion, shift, or irregularity in an image.

When the pressing roller 34 is pressed against the fixing roller 32 with a large force, the toner image may be shifted in the transport direction, i.e., image shift. The image shift occurs when an excessive strain is generated in the elastic layer on the fixing roller 32 due to the large pressing force of the pressing roller 34. However, in the embodiment, it is configured that the pressing pad 36 does not seize other component, thereby preventing the pressing force of the pressing roller 34 from increasing. Accordingly, it is possible to prevent the image shift, thereby improving image quality.

In the conventional fixing device shown in FIG. 2, the pressing pad 106 slides against the guide member. Since a space is formed between the pressing pad 106 and the guide member, when a pressing belt moves, the pressing pad 106 is inclined. Accordingly, as shown in FIG. 8, the pressing force of the pressing pad 106 at a nip portion B decreases, and a range of the nip portion B is widened.

In this case, it is difficult to suppress air and moisture generated from toner at the nip portion B, thereby increasing an amount of air or moisture generated from toner. Accordingly, when a sheet with less permeability such as a coated sheet is used, an image tends to be distorted.

On the other hand, in the embodiment, it is possible to prevent the pressing pad 36 from being inclined when the pressing belt 35 moves. Accordingly, it is possible to prevent the pressing force of the pressing pad 36 at the nip portion B from decreasing and a range of the nip portion B from being widened. As a result, it is possible to suppress air and moisture generated from toner, thereby preventing an image from being distorted and improving image quality.

In the conventional fixing device shown in FIG. 2, if the pressing pad 106 seizes the fixing roller 103 when the pressing belt 105 moves, the pressing force of the pressing pad 36 at the nip portion A increases and the pressing force of the pressing roller 34 at the nip portion C decreases as shown in FIG. 9. At this moment, if the pressing force of the pressing pad 106 becomes too large, a frictional force between the pressing belt 105 and the pressing pad 106 becomes greater than a frictional force between the pressing belt 105 and the fixing roller 103, thereby making it difficult to stably move the pressing belt 105. As a result, the pressing belt 105 may be cracked, thereby generating a slip stick phenomena and creating a jitter in an image.

On the other hand, in the embodiment, the supporting shafts sh1 are disposed such that the rotational radius R1 of the pressing roller 34 becomes smaller than or equal to the rotational radius R2 of the pressing pad 36 (R1≦R2). Accordingly, it is possible to prevent the pressing pad 36 from seizing the fixing roller 32 when the pressing belt 35 moves. As a result, it is possible to prevent the pressing force of the pressing pad 36 from becoming too large, thereby making it possible to stably move the pressing belt 35, and preventing jitter in an image and improving image quality.

Second Embodiment

A second embodiment of the present invention will be explained next. Components in the second embodiment similar to those in the first embodiment are designated with the same reference numerals, and explanations thereof are omitted. The components similar to those in the first embodiment provide the similar effects.

Figure 10:
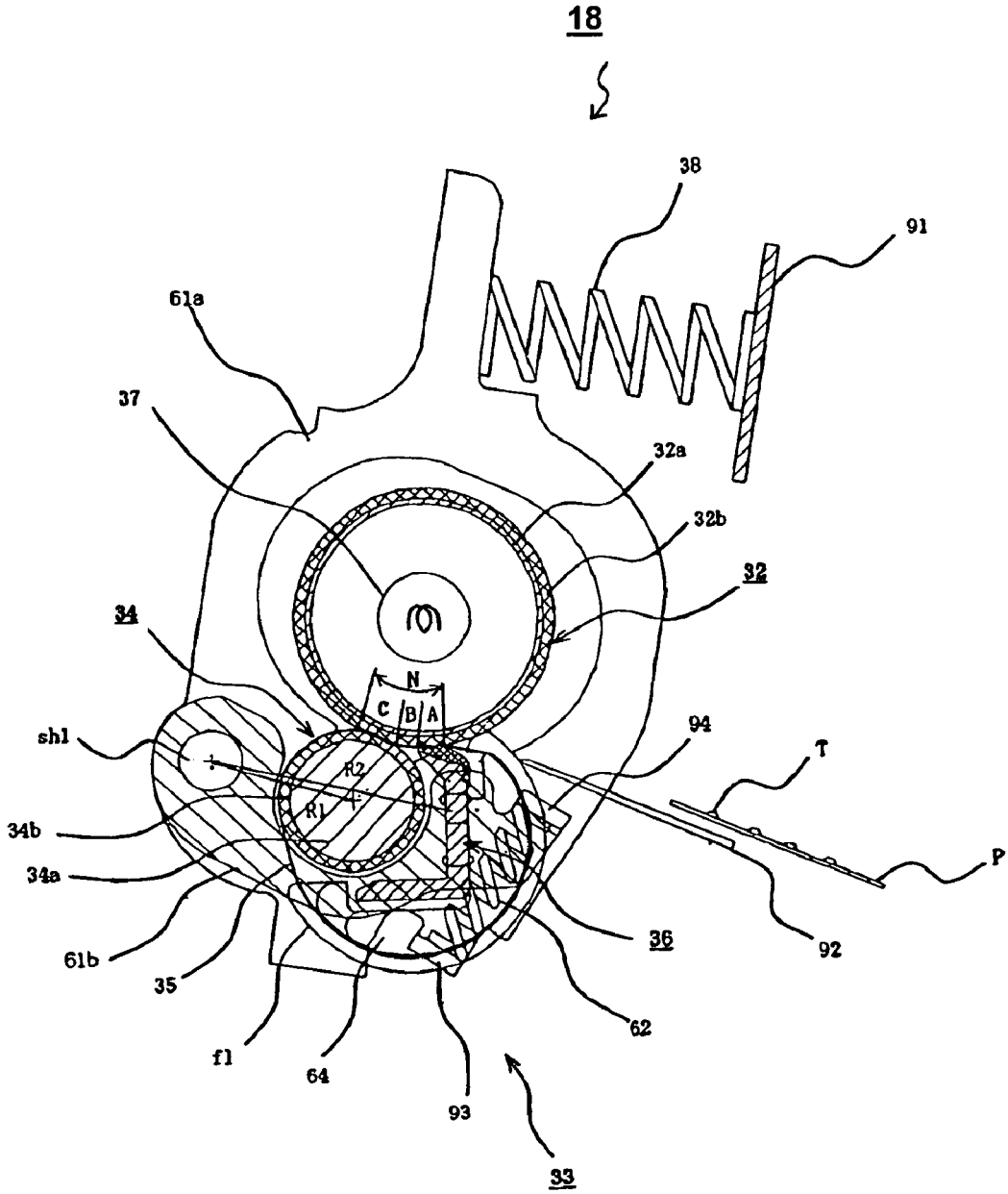
FIG. 10 is a schematic sectional view showing a fixing device according to a second embodiment of the present invention.
Figure 11:
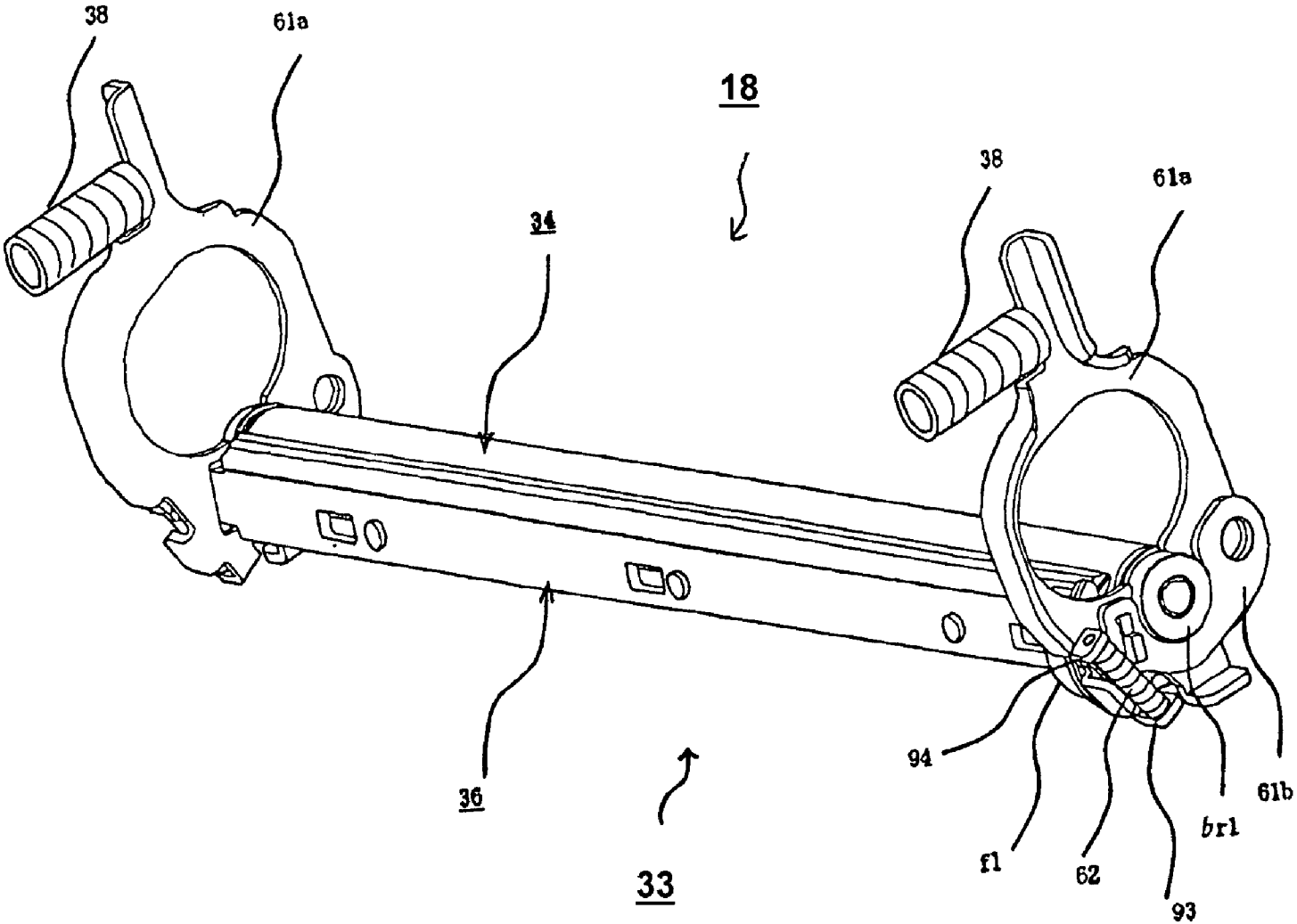
FIG. 11 is a perspective view showing a primary portion of the fixing device according to the second embodiment of the present invention.
Figure 12:
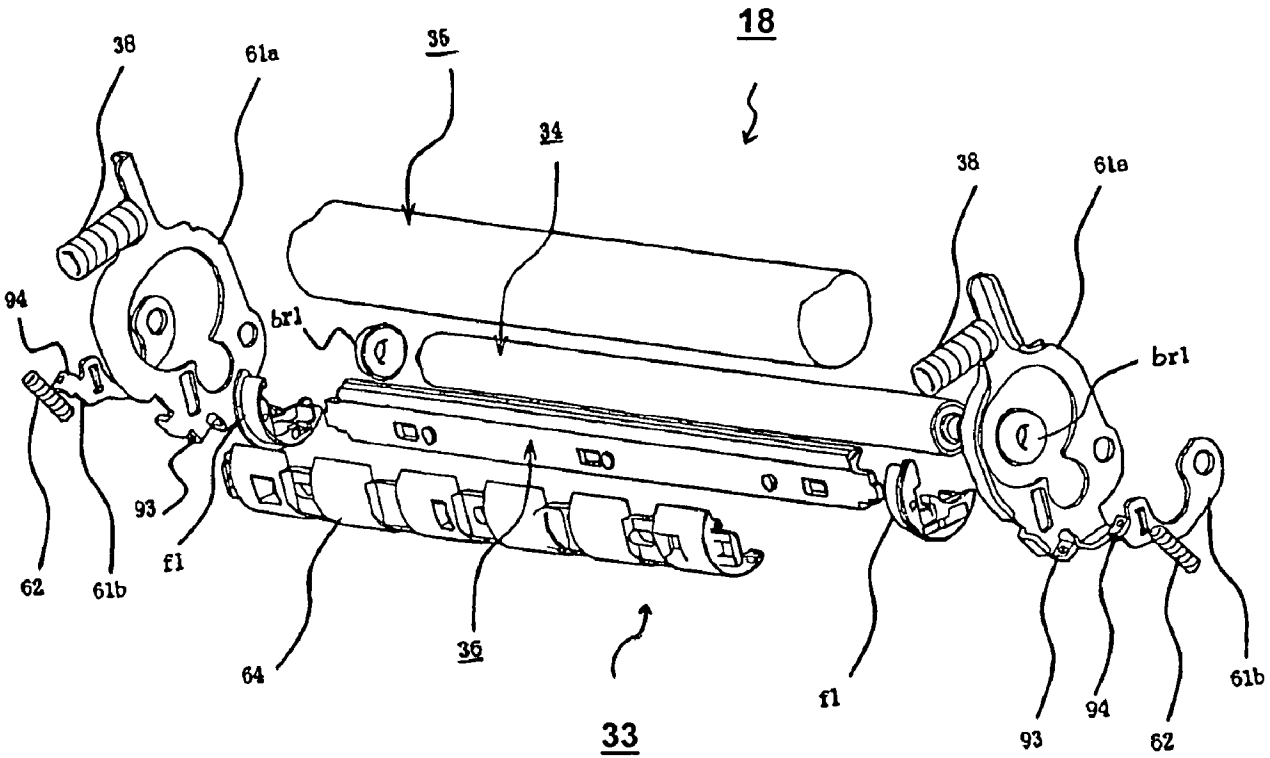
FIG. 12 is an exploded perspective view showing the primary portion of the fixing device according to the second embodiment of the present invention.

FIG. 10 is a schematic sectional view showing a fixing device according to the second embodiment of the present invention. FIG. 11 is a perspective view showing a primary portion of the fixing device according to the second embodiment of the present invention. FIG. 12 is an exploded perspective view showing the primary portion of the fixing device according to the second embodiment of the present invention.

As shown in FIGS. 11 and 12, the both end portions of the pressing roller 34 as the pushing member are supported on pressing roller levers 61*a* disposed at left and right sides as a first supporting member through the bearings br1, so that the pressing roller 34 is freely rotatable. The pressing roller levers 61*a* are disposed to be freely rotatable around the supporting shafts sh1 (FIG. 10) disposed on both side surfaces.

In the embodiment, the springs 38 as the first urging member are disposed between the pressing roller levers 61*a* and the front plate 91 (FIG. 10). Accordingly, the springs 38 urge the pressing roller levers 61*a* in a counterclockwise direction (FIG. 10), so that the pressing roller 34 is urged toward the fixing roller 32 as the heating member or fixing member.

In the embodiment, the both end portions of the pressing pad 36 as the pressing member are fixed and supported to pressing pad levers 61*b* disposed at left and right sides as a second supporting member. The pressing pad levers 61*b* are disposed to be freely rotatable around the supporting shafts sh1 (FIG. 10). Springs 62 as a second urging member are disposed between the pressing pad 36 and the pressing pad levers 61*b*, so that the springs 62 urge the pressing pad 36 toward the fixing roller 32.

In the embodiment, the springs 62 are disposed at the both end portions of the pressing pad 36. Each of the springs 62 has one end portion abutting against a stopper 93 formed as a cut portion at a specific position of one of the pressing pad levers 61*a*. Further, each of the springs 62 has the other end portion abutting against a stopper 94 formed as a cut portion at a specific position of one of the pressing pad levers 61*b*. In this case, the springs 62 are directly disposed between the pressing roller levers 61*a* and the pressing pad levers 61*b*. Accordingly, it is possible to reduce a size of the pressing belt assembly 33 as the pressing unit and a circumferential length of the pressing belt 35.

In the embodiment, the fixing roller 32 is formed of a hollow roller having an outer diameter of about 25 mm. In the fixing roller 32, a core metal portion is covered with the elastic layer 32*a* made of a silicone rubber with high temperature resistance and having a thickness of about 1.0 mm. Further, the outer circumferential surface is coated with the fluorine resin layer 32*b* as a release layer having a thickness of 30 μm.

In the embodiment, the pressing belt 35 has a two-layer structure formed of the base layer and the release layer coated on the base layer. The base layer is formed of a polyimide with high temperature resistance, and is formed in a belt member having a diameter of 24 mm and a thickness of 70 μm. The release layer is formed of a PFA coating having a thickness of 10 μm.

In the embodiment, the pressing roller 34 is formed of an elastic member having an outer diameter of 14 mm. More specifically, the metal core shaft 34*a* is covered with the elastic member 34*b* formed of a silicone sponge with heat resistance and having a thickness of 1 mm. The silicone sponge has a crown shape having an outer diameter difference of 0.2 mm to obtain a uniform pressure distribution along the axial direction of the pressing roller 34. Further, the pressing roller 34 and the fixing roller 32 form the nip portion C having a nip width of about 3 mm.

In the embodiment, the pressing pad 36 is formed of a base member; a heat resistant resin layer partially formed on the base member at a specific location; and a low friction member formed on a surface contacting with the pressing belt 35. Further, the pressing pad 36 is disposed such that the low friction member contacts with an inner surface of the pressing pad 36. The heat resistant resin layer is formed of a silicone rubber having a hardness of 15 to 40° (JICA).

In the embodiment, the heat resistant resin layer has a hardness of 40° and a thickness of about 1.0 mm. The heat resistant resin layer contacts with the pressing belt 35 in a contact width of about 4.0 mm in the direction that the pressing belt 35 moves. Further, the pressing pad 36 has a crown shape having a center portion protruding by 0.2 mm relative to both end portions thereof to obtain a uniform pressure distribution along the longitudinal direction of the pressing pad 36. The low friction member is provided for reducing friction between the inner surface of the pressing belt 35 and the surface of the pressing pad 36. The low friction member is formed of a silicone type coating containing graphite, and has a thickness of 20 μm.

In the embodiment, the pressing pad 36 is disposed apart from the pressing roller 34 by about 1.0 mm. The springs 62 urge the pressing pad 36 against the fixing roller 32 through the pressing belt 35. Further, the pressing pad 36 and the fixing roller 32 form the nip portion A having a nip width of about 3.0 mm with the pressing belt 35 inbetween.

In the embodiment, the springs 38 urge the pressing roller 34 and the springs 62 urge the pressing pad 36 such that the average surface pressure in the nip portion C becomes about 2.0 kg/cm$^2$ and the average surface pressure in the nip portion A becomes about 0.8 kg/cm$^2$. Further, the pressing belt 35 and the fixing roller 32 form the nip portion B (small pressure portion) between the nip portions A and C, and the pressing belt 35 is pressed against the fixing roller 32 in the nip portion B with tension thereof.

In the embodiment, a guide member 64 is supported on the pressing pad 36 for guiding the pressing belt 35. The supporting shafts sh1 are disposed such that a rotational radius R1 of the pressing roller 34 with the pressing roller levers 61*a* becomes smaller than or equal to a rotational radius R2 of the pressing pad 36 with the pressing pad levers 61*b* (R1≦R2).

In the embodiments described above, the printer is explained as the image forming apparatus. The image forming apparatus may include a copier, a facsimile, a multifunction device, and the like.

The disclosure of Japanese Patent Application No. 2006-096433, filed on Mar. 31, 2006, is incorporated in the application.

While the invention has been explained with reference to the specific embodiments of the invention, the explanation is illustrative and the invention is limited only by the appended claims.

What is claimed is:

1. A fixing device for fixing a developer image to a recording medium, comprising:

a heating member for heating the recording medium;

a pressing member for pressing the recording medium against the heating member;

a first supporting member for supporting the pressing member;

a first supporting shaft for supporting the first supporting member to be freely rotatable;

a first urging member for urging the first supporting member in a first rotational direction and urging the pressing member against the heating member;

a belt member disposed to contact with the heating member, said pressing member pressing the recording medium against the heating member through the belt member; and a pushing member disposed to contact with an inner surface of the belt member, said pushing member pressing the recording medium against the heating member through the belt member.

2. The fixing device according to claim 1, wherein said first supporting shaft is disposed outside the belt member.

3. The fixing device according to claim 1, further comprising a second supporting member for supporting the pushing member; a second supporting shaft for supporting the second supporting member to be freely rotatable; and a second urging member for urging the second supporting member in a second rotational direction and urging the pushing member against the heating member.

4. The fixing device according to claim 3, wherein said first supporting shaft and said second supporting shaft are arranged such that the first supporting member rotates in the first rotational direction by a first rotational radius and the second supporting member rotates in the second rotational direction by a second rotational radius, said first rotational radius being equal to or greater than the second rotational radius.

5. The fixing device according to claim 3, wherein said second urging member is disposed between the first supporting member and the second supporting member.

6. An image forming apparatus comprising the fixing device according to claim 1.

7. A fixing device for fixing a developer image to a recording medium, comprising:

a heating member for heating the recording medium;

a pressing member for pressing the recording medium against the heating member;

a first supporting member for supporting the pressing member;

a first supporting shaft for supporting the first supporting member to be freely rotatable;

a first urging member for urging the first supporting member in a first rotational direction and urging the pressing member against the heating member, wherein said first urging member includes a plurality of urging sections disposed along a longitudinal direction of the pressing member.

8. An image forming apparatus comprising the fixing device according to claim 7.

9. A fixing device for fixing a developer image to a recording medium, comprising:

a heating member for heating the recording medium;

a pressing member for pressing the recording medium against the heating member;

a first supporting member for supporting the pressing member;

a first supporting shaft for supporting the first supporting member to be freely rotatable;

a first urging member for urging the first supporting member in a first rotational direction and urging the pressing member against the heating member, wherein said pressing member includes a low friction member contacting with a belt member, said low friction member being formed of a silicone material containing graphite.

10. An image forming apparatus comprising the fixing device according to claim 9.

* * * * *